US011094227B1

(12) United States Patent
Piziali et al.

(10) Patent No.: US 11,094,227 B1
(45) Date of Patent: Aug. 17, 2021

(54) MAGNETIC EXTERIOR SHUTTER PRODUCT

(71) Applicant: Jamie Ann Piziali, Alexandria, VA (US)

(72) Inventors: Andrew Thomas Piziali, Alexandria, VA (US); Jamie Ann Piziali, Alexandria, VA (US); Joseph Marvin Piziali, North Muskegon, MI (US)

( * ) Notice: Subject to any disclaimer, the term of this patent is extended or adjusted under 35 U.S.C. 154(b) by 0 days.

(21) Appl. No.: 17/248,054

(22) Filed: Jan. 7, 2021

(51) Int. Cl.
*G09F 7/18* (2006.01)

(52) U.S. Cl.
CPC ..... *G09F 7/18* (2013.01); *G09F 2007/1852* (2013.01)

(58) Field of Classification Search
None
See application file for complete search history.

(56) References Cited

U.S. PATENT DOCUMENTS 4,852,284 A * 8/1989 Faggiano ..... G09F 7/00 40/488
5,675,874 A * 10/1997 Chen ..... A41F 1/002 24/303
5,771,618 A * 6/1998 Burke ..... G09F 7/04 248/223.41
5,930,927 A * 8/1999 Griffin ..... G09F 7/04 40/621
6,428,869 B1 * 8/2002 Ozgen ..... H01F 1/117 428/220
2004/0187417 A1 * 9/2004 Thomas ..... E06B 7/28 52/311.1
2005/0023420 A1 * 2/2005 Sadeh ..... B42F 11/04 248/206.5
2006/0150544 A1 * 7/2006 Foster ..... E06B 7/08 52/204.1
2008/0271855 A1 * 11/2008 Hirsh ..... A47H 99/00 160/38
2009/0071095 A1 * 3/2009 Buchwald ..... E06B 7/08 52/745.19
2015/0033602 A1 * 2/2015 Fuerst ..... A47G 1/0616 40/1
2015/0113843 A1 * 4/2015 Berry ..... G09F 7/04 40/600
2017/0066370 A1 * 3/2017 Bowe ..... B60R 13/00

* cited by examiner

*Primary Examiner* — Kristina N Junge

(57) ABSTRACT

The current invention is directed to a magnetic exterior shutter product. The magnetic exterior shutter product comprises a cutout and/or shutter. The cutout is attached to a first fastener wherein the first fastener comprises a first magnetic or ferromagnetic material. A first adhesive may attach the first fastener to the cutout. The cutout may be magnetically attached to an exterior shutter. The shutter may comprise a shutter front surface, a shutter rear surface, and a second fastener comprising a second magnetic or ferromagnetic material wherein the second fastener is attached to the shutter front surface, the shutter rear surface, or embedded between the shutter front surface and the shutter rear surface.

20 Claims, 6 Drawing Sheets

MAGNETIC EXTERIOR SHUTTER PRODUCT

FIELD OF THE INVENTION

The field of the present invention is exterior window shutters.

BACKGROUND OF THE INVENTION

Exterior window shutters are a common feature on the exterior of dwellings such as homes and apartment buildings. Hundreds of years ago exterior window shutters provided a variety of functions. Early exterior shutters were used for security in place of glass windows. They were also used for privacy, storm protection, insulation, and could help cool a home in the summer by permitting breezes to enter. Common shutter designs were louvered, single board, and board-and-batten. Later, solid raised paneled shutters and fixed louvered shutters arrived. Nowadays window shutters often only function to add curb appeal to a home by providing an aesthetically pleasing addition to a home exterior.

Shutters with a cutout design emerged sometime around the 1920s and are still popular today. Cutout shutters are made of wood with a portion of each shutter removed (cutout opening) in a selected design. Home owners express themselves by displaying a cutout shape that may capture the spirit of their home or convey a bit of their personality. Common shapes include stars, spades, flowers, butterflies, hearts, diamonds, and fleur-de-lis.

Although wood cutout shutters are beautiful, and add curb appeal to a home, they are expensive. Many homeowners are unable or unwilling to spend hundreds to thousands of dollars on wood cutout shutters. When new shutters are purchased the most commonly purchased shutters are fixed louvered vinyl or raised panel vinyl shutters found at many local home improvement stores. Wood cutout shutters are multiple times more expensive than the vinyl shutters. Although vinyl shutters come in a variety of colors and sizes, few if any come with cutout designs. Those lucky enough to afford wood cutout shutters are limited to their selected cutout design because once the selected shape is cut out of a wood shutter the process is irreversible. The homeowner is stuck with the selected cutout design unless brand new shutters are purchased and installed.

Rather than removing shutter material to form a shutter with a cutout opening, a cutout may be fastened to the front surface of a shutter. Surface applied shutter cutouts provide homeowners with a shutter cutout option that is more affordable than custom made cutout shutters. A difficulty with surface applied cutouts is how to attach cutouts to a shutter.

Screws and nails require a hole in a material to be fastened. Screws require a pre-drilled hole or they bore their own hole (self-tapping screws). Nails create a hole when driven, often by a hammer, into a material. Like screws and nails, bolts and rivets also require a hole. In addition, bolts and rivets further require the hole extend all the way through the fastened material and often require access to the area behind the fastened material. Bolts are inserted into a hole and secured with a nut on the other side of the fastened material. Rivets require a hole to insert the rivet shaft and often require access on the other side of the material to deform the tail. A homeowner may be unable or unwilling to make a hole in their shutters.

Screws, nails, bolts, and rivets, also suffer from the inability to easily disconnect a fastened material without a specialized tool. Screws require a screwdriver for removal. Nails are especially stubborn to remove as they require prying the nail out such as with a pry bar. Bolts removal requires a specialized tool such as a socket wrench. Most rivets are not designed for removal and often require drilling out the rivet to disconnect fastened materials and are often not reusable.

Adhesive is another type of fastener. Adhesive is available in a variety of forms, including liquids and solids. Adhesive allows for fastening without the need for a hole in the material to be fastened but, like screws, nails, bolts, and rivets, adhesive suffers from the inability to easily disconnect a fastened material. Plus, repositioning of adhered materials is difficult because even when an adhesive can be released the adhesive material cannot be reused for long before adhesion performance deteriorates.

Magnets are another type of fastener. When an article, such as a piece of paper, needs fastening to a ferromagnetic material, such as a refrigerator, the paper may be placed between the refrigerator and a magnet to fasten the paper to the refrigerator. Since many shutters are made of a non-magnetic material such as vinyl or wood, magnets do not attract to a shutter. Plus, some magnets corrode easily when exposed to external weather conditions.

The current invention allows a homeowner or apartment renter to easily add and remove a cutout from a shutter. The cutouts are easily interchangeable and may be added and removed numerous times, including with a change in orientation, without any change in fastener strength. The current invention also provides homeowners the ability to vary cutout shapes quickly, easily, reversibly, and affordably. In embodiments of invention the attachment means does not require a specialized tool, does not destroy any portion of the shutter, and no visible change is made to the front surface of the shutter. The current invention provides cutout solutions for the construction of new shutters and cutout solutions for existing shutters.

DESCRIPTION OF THE PRIOR ART

The prior art discloses various attempts to decorate exterior shutters with decorative panels, ornaments, and cutouts.

U.S. Pat. No. 3,762,119 to Sowie discloses an exterior shutter panel assembly wherein an entire shutter is covered by a removable decorative shutter panel. The panels are made of sheet metal and mechanically attach to the shutter by hooks and tabs along the sides and top of the shutter.

U.S. Pat. No. 6,866,940 to Laughlin discloses a decorative ornament that removably clips onto the louvers of an exterior shutter. The hooks are connected to springs such that the hooks apply compressive force to attach to the shutter louvers.

US Patent Application Publication No. 2004/0187417 to Thomas discloses ornaments removably attached to the surface of exterior shutters by any of a large variety of methods including removable adhesive, hook and loop fasteners, clamps, snaps, and brackets.

US Patent Application Publication No. 2006/0150544 to Foster discloses decorative shutters wherein a cutout panel may be removably fastened to the front surface of a shutter. The attachment means may include a pair of cooperating fastener means, one fastener means is adhered to the front side of the shutter and the other fastener means is adhered to the rear side edges of the panel. Each fastener means comprises multiple magnets.

US Patent Application Publication No. 2008/0271855 to Hirsh et al. discloses an exterior shutter panel assembly wherein an entire shutter may be covered by a decorative shutter panel. The panels may be attached by a magnetic attachment member that attaches to the top edge of the shutter.

The shutters and cutouts of the prior art include fastening means that comprise cumbersome mechanical attachment means, require a plurality of fasteners, cannot be orientation varied, and/or deface the front of a shutter. Plus, some exterior shutters, such as second story or higher shutters, are not easily accessible. The prior art fails to disclose an exterior shutter comprising a cutout fastening means wherein cutouts can be securely yet easily removable from the surface of a shutter by reaching through the window adjacent the shutter. The prior art also fails to address deterioration of fasteners due repeated use or due to the exterior environment. The current invention solves the above problems.

BRIEF SUMMARY OF THE INVENTION

Rather than removing material to form a shutter with a cutout, the current invention relies on the placement of one or more cutouts on a shutter. A first fastener is attached to a cutout and a second fastener is attached to a shutter. The first and second fasteners are magnetically attracted such that a cutout is magnetically adhered to the shutter.

The second fastener may be attached to the front surface of the shutter and covered with a cover layer. Alternatively, the second fastener may be attached to the rear surface of the shutter or embedded between the front and rear surfaces of the shutter. The magnetic attractive force between the first and second fasteners passes through the cover layer or shutter such that the first and second fasteners attract and magnetically adhere the cutout to the front of the shutter.

An advantage of the current invention is that the cutout may be rotated a full and continuous 360 degrees without removing the cutout from the shutter. Another advantage is that a cutout may be added and removed numerous times without any change in fastener strength. Another advantage is that a cutout can be easily added and removed from the surface of a shutter by simply reaching through a window adjacent the shutter. An advantage of placing the second fastener on the rear surface of the shutter, or embedded between the front and rear surfaces of the shutter, is that the second fastener is concealed such that when the shutter is installed, such as on a home, the shutter appears unaltered. Another advantage is that the second fastener is shielded from the environment such as rain, snow, wind, sun, or sea water spray. Another advantage is that the second fastener avoids direct contact with the first fastener such that the second fastener avoids physical damage from repeated use.

BRIEF DESCRIPTION OF THE DRAWINGS

The accompanying drawings represent non-limiting, example embodiments of the invention.

DETAILED DESCRIPTION OF THE INVENTION

Figure 1:
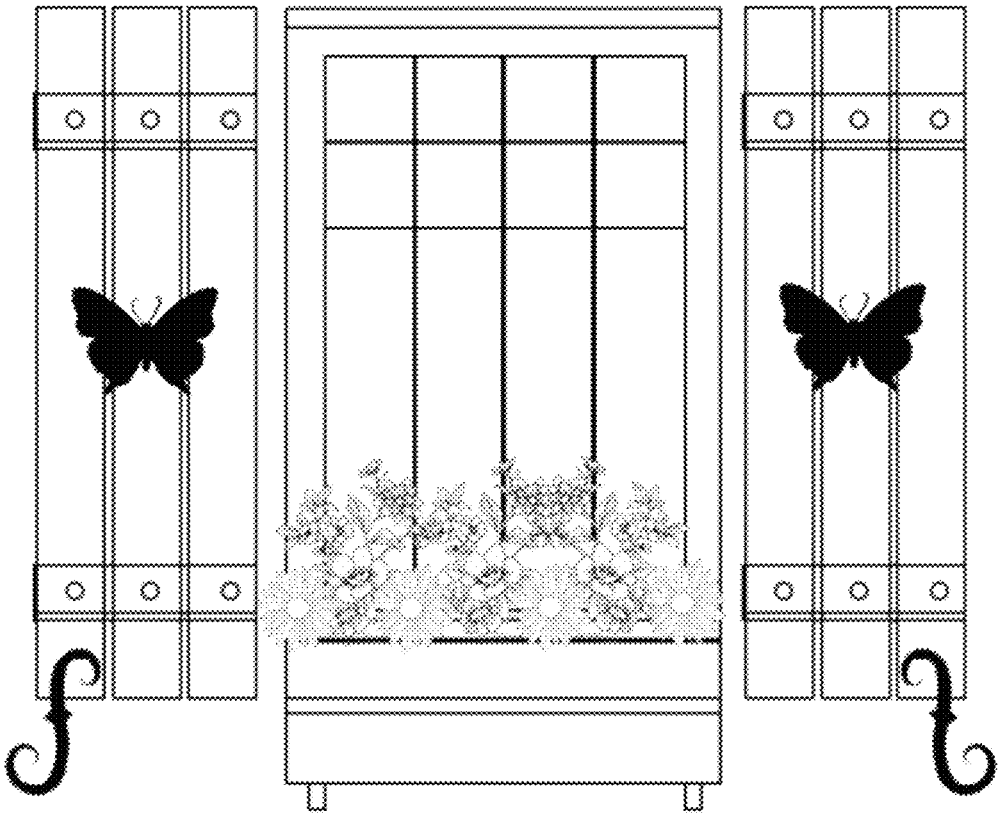
FIG. 1 is a front view of two board and batten shutters with a butterfly shaped cutout on the front surface of each shutter in accordance with the present invention.
Figure 2:
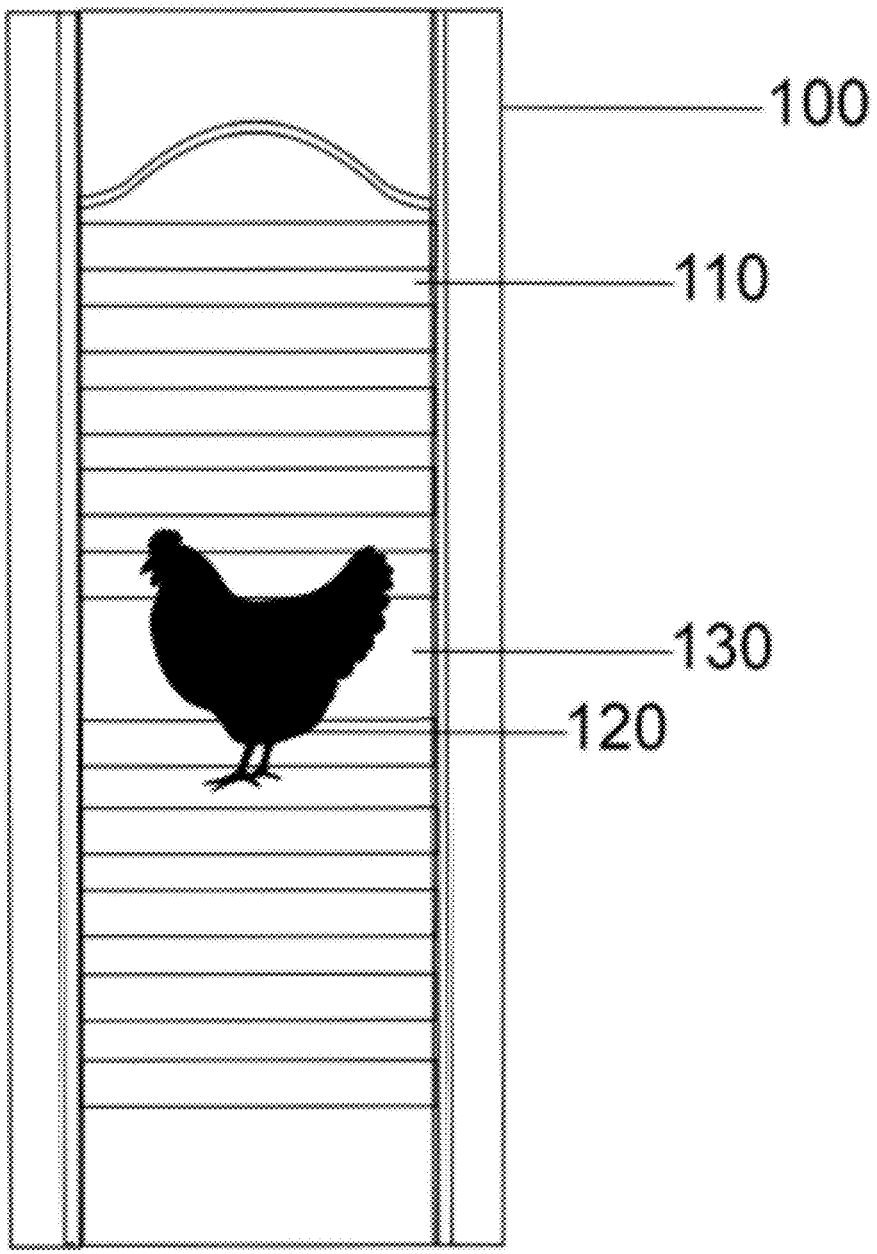
FIG. 2 is a front view of a vinyl louvered shutter 100 showing a fixed louver 110 and a chicken shaped cutout 120 attached to the shutter front surface 130.
Figure 3:
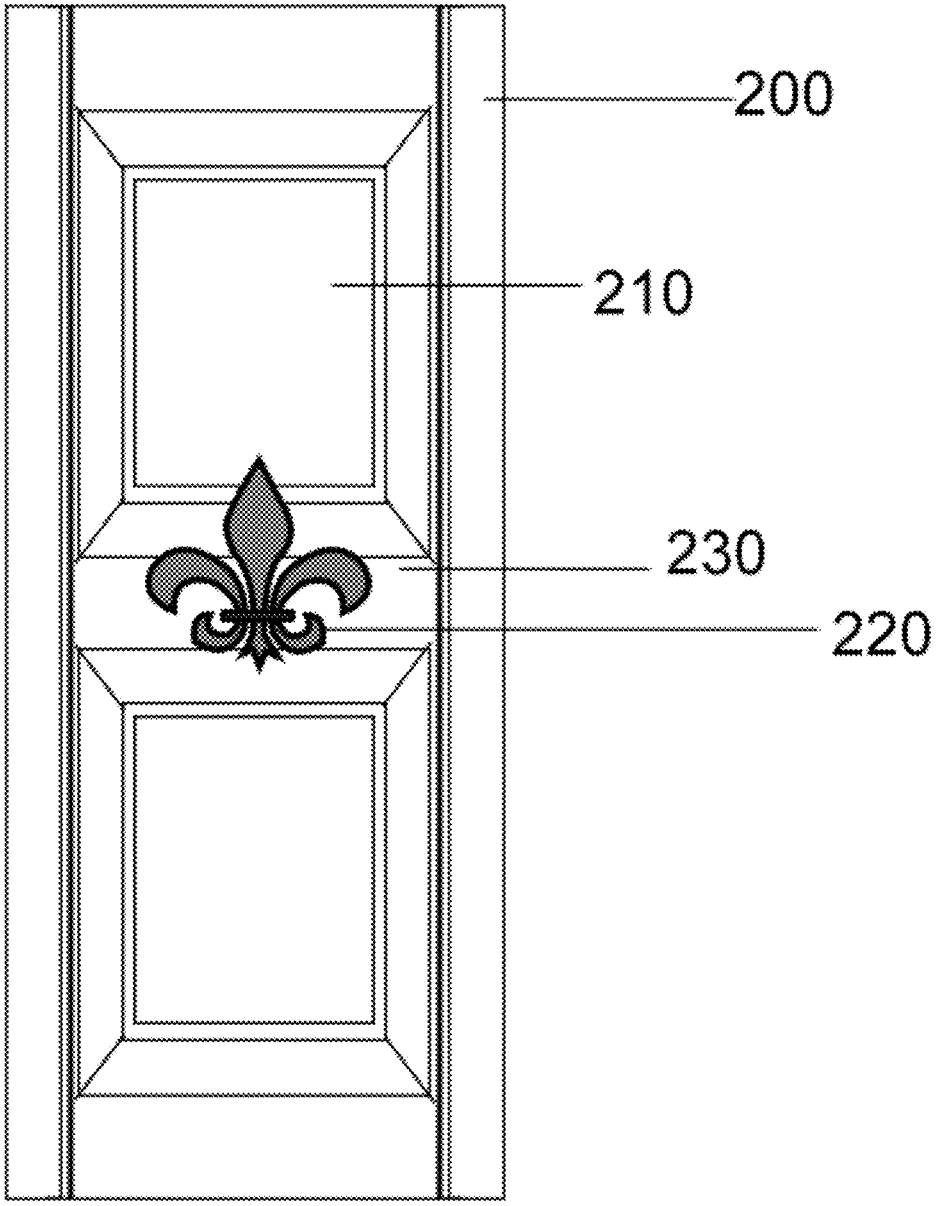
FIG. 3 is a front view of a vinyl raised panel shutter 200 showing a raised panel 210 and a fleur-de-lis shaped cutout 220 attached to the shutter front surface 230.

The current invention is directed to a magnetic exterior shutter product. The magnetic exterior shutter product comprises a cutout and/or shutter. The cutout is attached to a first fastener wherein the first fastener comprises a first magnetic or ferromagnetic material. A first adhesive may attach the first fastener to the cutout. The cutout may be magnetically attached to an exterior shutter. The shutter may comprise a shutter front surface, a shutter rear surface, and a second fastener comprising a second magnetic or ferromagnetic material wherein the second fastener is attached to the shutter front surface, the shutter rear surface, or embedded between the shutter front surface and the shutter rear surface. When attached to the shutter front surface the second fastener comprises a countersunk hole and/or an outer cover. When attached to the shutter rear surface, or embedded in the shutter, the second fastener is spaced from the shutter front surface by a first material located between the second fastener and the shutter front surface.

The current invention is also directed to fastener kits. A first kit comprises the first fastener and a second kit comprises the second fastener.

The current invention is also directed to a method of making the magnetic exterior shutter product.

The current invention is also directed to methods of making fastener kits. A first method makes the first kit comprising the first fastener and second method makes the second kit comprising the second fastener.

Definitions

As used herein the term "about" includes the stated amount and up to 10% more and up to 10% less than the stated amount.

As used herein all ranges disclosed and claimed include the disclosed or claimed range end points and all numerical values therebetween. For example, a length range of between 1 and 5 inches includes 1 inch and 5 inches and all the values therebetween such as 1.01, 1.10, 2.0, and so on.

As used herein the term "shutter" describes an exterior shutter designed to be positioned on the exterior face of a structure, such as a house, to the left or right of a window. Exterior shutters, as opposed to interior shutters, are constructed of materials capable of enduring harsh exterior conditions such as rain, wind, snow, and sun for years without any substantial change in structure or appearance.

As used herein the term "shutter product" describes a product that relates to exterior shutters. Shutter products range from a product that is designed to attach to an exterior shutter to an entire exterior shutter.

As used herein the term "shutter front surface" refers to the decorative surface of a shutter designed to face away from a structure, such as a house, when installed to the left or right of a window.

As used herein the term "shutter rear surface" refers to the surface of a shutter located on the side of the shutter opposite the front surface and designed to face a structure, such as a house, when installed to the left or right of a window.

As used herein the term "vinyl shutter" refers to a shutter made of vinyl and molded with a design finished on only the front surface and having an open or hollow back. Vinyl shutters are decorative in nature and cannot be used as functional shutters. They are often injection molded as one-piece with protruding back edging to space the shutter from the installed structure surface.

As used herein "louvered" means the shutter front surface comprises one or more louvered areas wherein each louvered area is continuous and comprises a plurality of louvers. The shutter may comprise one or more louvered areas, often separated by a flat panel area that runs widthwise. The louvered areas may be surrounded by flat panel areas that may span the entire height and width of the shutter and form a shutter border. The louvered shutters may include decorative areas, such as above a louvered area, wherein the decorative area comprises a curved or protruding shape. The shutters may comprise fixed or functional louvers which may shed rain, allow air transfer, filter direct sunlight, protect from small flying debris, provide security, provide protection from severe weather, and/or provide privacy.

As used herein the term "fixed louvered" means a louvered shutter wherein the louvers are permanently fixed in position.

As used herein "raised panel" means a shutter front surface comprises one or more raised panel areas separated by a flat panel area that runs widthwise. The raised panels are often square or rectangular shaped. The panel areas of each shutter may vary in size and shape. One shutter may comprise multiple panel areas wherein each panel has a different shape and/or size. The panel areas may be surrounded by flat panel areas that may span the entire height and width of the shutter and form a shutter border.

As used herein "grooved panel" means the shutter front surface comprises one or more grooved panel areas separated by a flat panel area that runs widthwise. The grooved panels are often square or rectangular shaped. The panel areas of each shutter may vary in size and shape. One shutter may comprise multiple panel areas wherein each panel has a different shape and/or size. The panel areas may be surrounded by flat panel areas that may span the entire height and width of the shutter and form the shutter border.

As used herein "board and batten" means the shutter front surface comprises two or more vertically adjacent boards and one or more battens that extend across the boards horizontally. For example, board and batten shutters may comprise 2 to 6 boards and 2 to 4 battens. The boards and battens of each shutter may vary in size and shape. For example, one shutter may comprise multiple boards wherein one or more boards has a different width than one or more other boards. The battens may extend less than or the entire width of the shutter. The shutters may be any variation of board and batten shutters including S-shutters or X-shutters.

As used herein a "cutout" is a self-supporting, substantially rigid ornament comprising a cut out border shape. A cutout may comprise a cut out outer border or a cutout may be a panel comprising a cut out inner border. Example cutout shapes include places, objects, people, animals, words, letters, names, and symbols. A cutout possesses sufficient structural integrity to maintain its shape when handled and resists deformation. A cutout forms a silhouette when placed against a contrasting backdrop such as a shutter.

As used herein "completely coated" means all exposed surfaces are coated.

As used herein a "magnetic material" is a material that is magnetized and creates its own persistent magnetic field.

Shutters

The shutters of the current invention are not limited by any particular shutter design. Common shutter designs known to those skilled in the shutter art include louvered, board and batten, raised panel, grooved panel, and combinations thereof.

The shutters of the current invention are not limited by any particular shutter material. For example, the shutter material may be polymeric, wood, fiberglass, aluminum, composite, or a combination thereof. The shutter may comprise from about 5 to about 100%, preferably about 50 to about 100% by weight, and most preferably about 75 to about 100% by weight polymeric, wood, or composite material, wherein the weight percentage is based on the weight of the shutter. Polymeric materials include vinyl and PVC. Vinyl is the preferred polymeric shutter material. Wood materials include woods such as cedar, pine, and basswood. Composites include wood composites such as wood fiber adhered with polymeric resin.

The shutters of the current invention are not limited by any particular size. The shutters may have a height of about 10 to about 100 inches, 20 to about 80 inches, or about 30 to about 70 inches. The shutters may have a width of about 5 to about 50 inches, about 10 to about 30 inches, or about 12 to about 25 inches. The shutters may have a thickness of about 0.01 to about 6 inches, about 0.5 inch to about 3 inches, or about 1 inch to about 2 inches. Plastic shutters may be molded and may have a material (plastic wall) thickness of about 0.01 to about 2 inches, about 0.05 to about 1 inch, about 0.1 to about 0.25 inch, or about 0.125 inch.

The shutters of the current invention are not limited to any particular color. Example colors include white, black, blue, brown, gray, green, red, tan, and yellow. The shutters may be made of colored material, such as colored vinyl, or the shutters may be coated with a color such as by painting.

The shutters of the current invention are not limited to any particular surface texture. The shutters may have a substantially smooth rear surface and a textured front surface. The texture may be a wood grain texture possessing lines and curves substantially similar to the surface of real wood. For example, the shutter may be made of real wood or may be made of plastic and molded with a wood grain texture. The wood texture may resemble natural wood texture with asymmetric horizontal grain structure and possibly knots.

The shutters of the current invention may comprise a marking on the rear surface to indicate fastener positioning. The marking may be molded into the rear surface or printed onto the rear surface. The marking may include wording such as "Place Magnet Here" or an image or outline such as that of a magnet.

The shutters of the current invention may comprise a protrusion on the rear surface for fastener positioning. For example, a shutter may comprise a solid or hollow post for a magnet with a hole to slip over. If hollow, the post may have a threaded interior to accept a screw. Alternatively, a shutter may comprise a protruding outline of a magnet shape to indicate positioning of a fastener on the rear surface.

Cutouts

Possible cutout materials include plastic, metal, wood, ceramic, and glass. Cutouts of the current invention are preferably made of one or more weather resistant materials suitable for outdoor use. The material is preferably capable of extended outdoor use, such as one or more years, without any substantial change in shape, weight, bending strength, tensile strength, and/or appearance. Preferably, the material is waterproof. Examples of materials inherently capable of extended outdoor use include naturally weather resistant solid woods, such cedar, cypress, and redwood, metals such as aluminum and stainless steel, plastics such as acrylic or PVC, and glass. Other solid woods that may be used include rot-resistant woods such as mahogany, teak, white oak, black cherry, and black walnut. The materials may be top coated for additional weather resistance. Suitable topcoat materials include paint, waterproofing oils, and urethane. Plywood material may be used but a suitable topcoat material is recommended as plywood is not conventionally constructed for outdoor use.

The preferred cutout materials are acrylic, PVC, and wood. The cutout may comprise between 0 to 100 wt. % acrylic, PVC, or wood based on the weight of the cutout. Preferably the cutout comprises 50 to 100 wt. % acrylic, PVC, or wood. Most preferably the cutout comprises 100% acrylic, PVC, or wood.

The cutout material may be homogeneous or heterogeneous throughout. Preferably, the cutout is cut from a single homogeneous sheet of substantially uniform thickness material. The most preferred cutout material is acrylic. Acrylic is available in a variety of colors, has an attractive appearance, high strength, stiffness, bonds well to adhesive, and has outstanding weathering properties. Laser cut acrylic is most preferable as the laser cut edges are smooth and glossy compared to other cutting methods such as blade, knife, or CNC machine cutting. The material may be opaque, transparent, translucent, or a combination thereof. Opaque is considered to have light transmission of about 5% or less, transparent has a light transmission of about 5 to about 30%, and translucent has a light transmission of greater than about 30%. Preferably, the cutout is opaque or transparent, preferably opaque, to stand out against the shutter backdrop and conceal backside fasteners.

The cutouts may have a preselected shape or may be customized. One method of making cutouts is to allow customers to select or submit desired cutout shapes and in turn a manufacturer will manufacture the shapes with the desired sizes and materials. This process may be done in a store or online through a website. The cutouts may have any desired shape and are preferably smaller in relation to the height and width dimensions of the shutter. The shape may be selected to express a homeowner's personality, feeling, belief, like, dislike, hobby, preferred sports team, brand, logo, trademark, local school, university, political party, or special events such as a birthday, holiday, wedding, graduation, or birth. Example shapes include a pine tree, bird, star, spade, diamond, fleur-de-lis, heart, flower, cross, dragon, butterfly, flag, race car, pumpkin, ghost, turkey, Christmas tree, snowman, and a snowflake. The shape may be solid or include one or more areas wherein material is cutout. The cutouts may also be selectively coated or painted. Example cutouts are disclosed in US Patent Application Publication No. 2004/0187417 to Thomas, which are incorporated by reference.

The cutouts have a height and width suitable for viewing. The cutout design should be visible a distance from the shutter location. The distance depends on the shutter location and the surrounding area. Shutters facing a sidewalk or street may have a size comfortably viewed from the sidewalk or street. Shutters located on a second or higher floor may be bigger than a cutout located on a first floor. The cutout size may also depend on the size of the shutter. Larger shutters may require a larger cutout to appear proportional. If more than one cutout is fastened to a single shutter than the individual cutouts may be smaller than when a single cutout is fastened to a shutter. Cutouts may range in height and width from an inch or less to 6 feet or more. Preferably, cutouts have a height and width each about 2 inches to about 18 inches, more preferably about 5 to about 12 inches. A most preferred cutout height and width range is 6 to 10 inches but smaller or larger cutouts are perfectly acceptable. A height and/or width of about 8 inches is suitable for most applications. Preferably, the cutout has a height or width of at least 5 inches. If the cutout is too large for a single fastener two or more fasteners may be used to fasten the large cutout to a shutter.

The cutouts should have a suitable thickness for fastening. The thickness must be sufficient to provide the cutout with enough stiffness and strength to be fastened and unfastened. The thickness will vary based on the cutout material. A suitable cutout thickness range is 0.1 to 1 inch but thinner or thicker cutouts are acceptable depending on the material. A more preferred cutout thickness range is 0.075 to 0.35 inch. The most preferred range is 0.08 to 0.16 inch. For wood, a most preferred thickness is about ¼ inch. For acrylic, a most preferred thickness is about ⅛ inch (about 3 mm). The cutout thickness may be substantially uniform or non-uniform throughout.

The cutouts may be solid or have one or more cutouts within or on a cutout. The cutout may be homogeneous or heterogeneous. The cutouts may be a single color or comprise multiple colors. The cutouts may also be mirrored, sparkly, fluorescent, glow-in-the dark, backlit, and/or illuminated such as with one or more LEDs. The cutouts may also be multi-layered with materials stacked. For example, an acrylic cutout may comprise one or more smaller and differently colored cutout of acrylic or a different material stacked on the first cutout to provide the cutout with multiple colors and/or a 3D effect. Each additional cutout may be bonded by any suitable method such as adhesive.

In one embodiment of the invention a first cutout has one or more holes and a second cutout comprising a color different than the color of the first cutout is attached to the rear surface of the first cutout such as with glue or adhesive. The holes provide a multi-color effect. For example, the rear surface of a first green Christmas tree cutout with multiple ornament holes may be adhesively bonded to the front surface of an otherwise identical second red Christmas tree but without any holes. The front surface of the cutout has the appearance of a green Christmas tree with red ornaments. Alternatively, the second cutout may have a shape different than the first cutout, such as a circle.

In another embodiment of the invention a first cutout may comprise one or more magnets attached, such as with adhesive, to the front surface of the first cutout such that one or more smaller second cutouts with a magnet attached to a rear surface, such as with adhesive, may be magnetically bonded to the front surface of the first cutout. For example, a jack-o-lantern cutout may comprise one or magnets adhered to the front surface such that a second cutout with a jack-o-lantern mouth shape and comprising a magnet adhered to the rear surface may be magnetically attached to the front surface of the jack-o-lantern cutout. Such a design would allow a single jack-o-lantern cutout to be decorated with interchangeable jack-o-lantern mouth cutout. The same process could be applied to interchangeable jack-o-lantern eyes and/or noses.

The current invention may include mini-cutouts substantially identical to the earlier described cutouts but smaller in height and/or width than earlier described. The mini-cutouts may have a height and/or width as small as one inch or even smaller. Mini-cutouts may be positioned to accentuate the larger cutouts or provide background decoration to the shutter. For example, the front surface of a shutter may comprise one or more flower cutouts and a sun shaped mini-cutout and/or a cloud shaped min-cutout may also be attached to the shutter front surface.

Fasteners

At least one first fastener is attached to a cutout and at least one second fastener is attached to a shutter. The first and second fasteners are magnetically attracted such that the cutout is magnetically adhered to the shutter.

Figure 4:
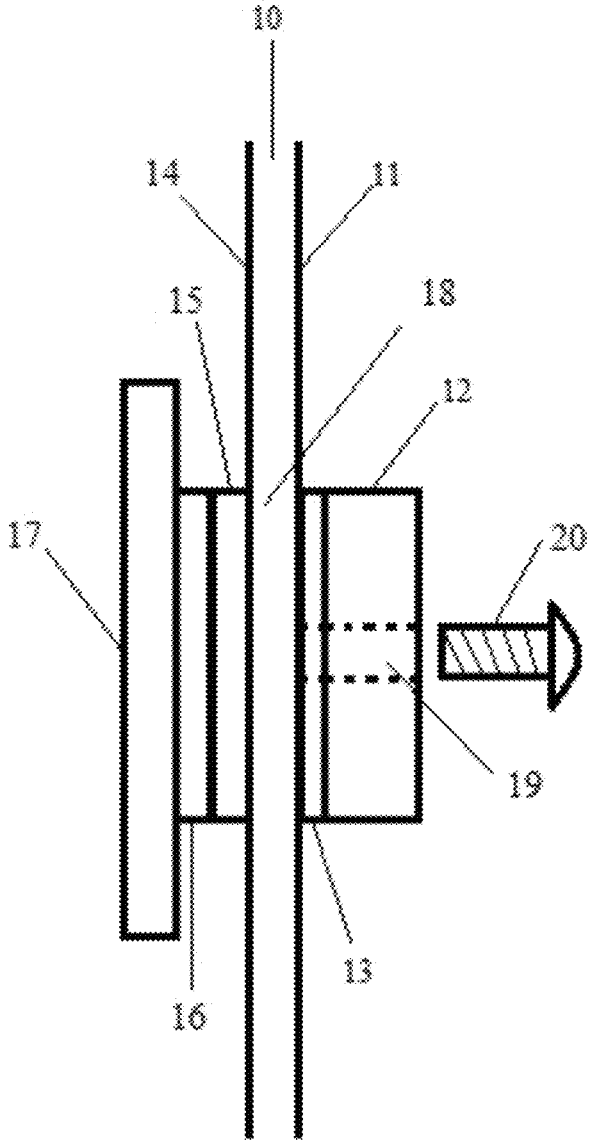
FIG. 4 is a side view of an embodiment of the invention wherein a second adhesive 13 attaches a second fastener 12 to a shutter rear surface 11 and a first adhesive 16 attaches a cutout 17 to a first fastener 15 magnetically attracted to the shutter front surface 14.

In one embodiment of the invention a second fastener is positioned such that the second fastener is not visible when the shutter is installed against a structure. For example, as shown in FIG. 4, a second fastener 12 may be attached to the shutter rear surface 11 of a shutter 10 with a second adhesive 13. The second fastener 12 and the second adhesive 13 may be ring shaped. A first fastener 15 is attached to a cutout 17 with a first adhesive 16. The cutout 17 may have any desired shape and the first adhesive 16 and the first fastener 15 may each have a disc shape. A second material 18 is located between the second fastener 12 and the first fastener 15. The second fastener 12 and first fastener 15 are magnetically attracted through the second adhesive 13 and the first material 18. The first material 18 and the second adhesive 13 must be sufficiently thin, and the magnetic attraction between the second fastener 12 and first fastener 15 must be sufficiently strong, such that a cutout 17 attached to the first fastener 15 will be sufficiently pressed against the shutter front surface 14 and remain positioned against the shutter front surface 14 unless intentionally removed.

In addition to or in place of the second adhesive 13, a post 19 may be attached to the shutter rear surface 11. The post 19 may be molded as part of the shutter 10 or attached to the rear surface of the shutter 11 with an attachment means such as adhesive. The second fastener 12 may have a ring shape such that a hole in the second fastener 12 slips onto the post 19 and a screw 20 may anchor the second fastener 12 to the shutter rear surface 11. The post 19 and screw 20 may have any desired shape, such as round or square, and may connect together with any desired locking mechanism. For example, the post may be hollow with inside thread and have a square cross-sectional outer shape such that the first fastener may comprise a square shaped hole that may slip onto the post while the screw screws into the head of the post to mechanically lock the second fastener to the shutter. In another example the post and/or screw may not have threads and the post or screw may be being slightly larger than the other such that the two components lock together by expansion and/or friction.

One or more posts may be strategically positioned on the rear surface of the shutter to align with desirable cutout locations of the front of the shutter. The one or more posts may be manufactured by any suitable means and made of any suitable material. For example, the one or more posts may be molded of vinyl during manufacturing of a vinyl shutter. Alternatively, the one or more posts may comprise polymeric or metal material adhered or screwed to the rear surface of the shutter such as to retrofit a shutter. The one or more posts may prevent the one or more second fasteners from rotating and/or provide installation guidance as to ensure correct second fastener positioning. The second adhesive may comprise one or more holes complimentary to the one or more holes in the second fastener or the second fastener may be in direct contact with the rear surface of the shutter without any adhesive present.

In another embodiment of the invention a second fastener is attached to the rear surface of the shutter by an alternative method wherein a backing material is draped over the back of the second fastener and the backing material is attached to the shutter rear surface. Any suitable attachment method may be used. The second fastener may be in direct or indirect contact with the rear surface of the shutter and the backing material may anchor the second fastener in position. For example, a first surface of the second fastener may be in direct contact with the rear surface of the shutter and a second surface of the second fastener, opposite the first surface, may be in contact with the backing material. The backing material may partially or completely cover the second surface of the second fastener and may be larger in area than the second fastener to extend beyond the edges of the second fastener and attach to the rear surface of the shutter. The backing material that extends beyond the second fastener may be attached to the rear shutter surface by any suitable means, such as adhesive. The backing material may form a pocket attached to the rear surface of the shutter and containing the second fastener.

In one embodiment of the invention a hole may be created in the rear of a shutter for one or more second fasteners. For example, a wood shutter may have a flat bottom hole drilled into the rear of the shutter, but not all the way through the thickness of the shutter, and a second fastener such as a magnet may be secured within the hole. The hole may extend to within about 0.01 to about 0.50 inches of the shutter frontside. Preferably, less than or equal to about 0.25 inch. The hole may be drilled into a new shutter or an old shutter may be removed from a house exterior, drilled, magnet installed, and then the shutter may be reinstalled. Such a design allows a cutout to be magnetically fastened to the front surface of the shutter without any fastener marring the front surface of the shutter or visible on the front surface of the shutter.

Figure 5:
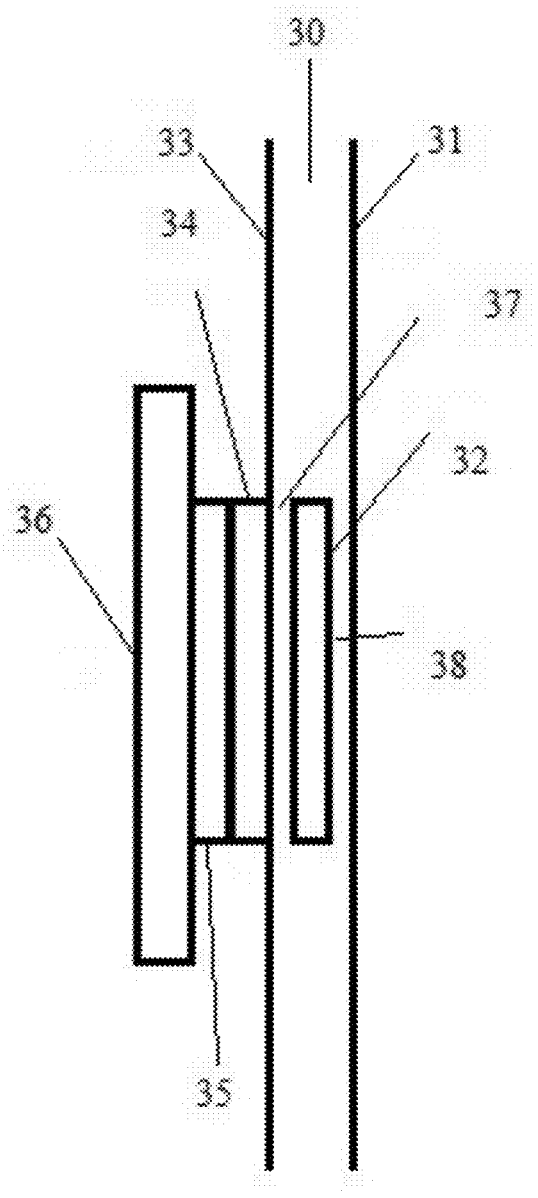
FIG. 5 is a side view of an embodiment of the invention wherein a second fastener 38 is embedded within a shutter 30 and a cutout 36 attached to a first fastener 34 is magnetically attracted to the shutter front surface 33.

In one embodiment of the invention, as shown in FIG. 5, a second fastener 32 is embedded within a shutter 30. A first material 37 and a second material 38 sandwich the second fastener 32 within the shutter 30. For example, the shutter 30 may be molded or otherwise formed with a second fastener 32, such as a magnet or magnetic material, partially or completely embedded within the shutter 30 during or after construction. The embedded material may be a magnet or a metal that attracts to a magnet. The embedded material may have any desired shape and size. For example, a shutter may be constructed with one or more round discs or strips of magnet or metal embedded within the shutter 30 such that a first fastener 34 of a cutout 36 will be magnetically attracted to the front surface 33 of the shutter 30. The first fastener 34 may be attached to the cutout 36 with a first adhesive 35. The first material 37 must be sufficiently thin, and the magnetic attraction between the second fastener 32 and first fastener 34 must be sufficiently strong, such that a cutout 36 attached to the first fastener 34 will be sufficiently pressed against the shutter front surface 33 and remain positioned against the shutter front surface 33 unless intentionally removed.

When the second fastener is embedded within the shutter the second fastener may comprise one or more holes. The one or more second fastener holes may be filled during or after manufacturing. For example, during molding of a vinyl shutter the second fastener may be embedded within the shutter and the vinyl material may be molded around the second fastener and partially or fully through the one or more holes, such as square holes, of the second fastener. The vinyl material extending within the one or more holes forms a bridge that anchors the second fastener into a set position such that the second fastener is prevented from rotating even when the second fastener is round shaped. A cutout attached to a first fastener, such as a round fastener, may be magnetically attracted to the embedded second fastener anchored within the shutter.

In one embodiment of the invention a portion or the entire shutter surface may be constructed to be magnetically attracted to one or more cutouts. For example, the shutter material may be vinyl impregnated with magnetic or ferromagnetic particles. Such a design would allow one or more cutouts to be placed at one or more desired shutter front surface locations. Similarly, the cutout may be attached to a first fastener or may be formed with a first fastener embedded within the cutout during or after construction.

The second fastener may have any desired shape and size. In one embodiment of the invention the second fastener has a size and shape substantially identical to the size and shape of the rear surface of the shutter such that the entire front surface of the shutter magnetically attracts one or more cutouts. The second fastener may have a shape that matches a recess in the back of a shutter such as a recess in the back of a vinyl shutter. In another embodiment of the invention one or more second fasteners are smaller than the size of the rear surface of the shutter and are positioned to occupy one or more recesses on the back of the shutter. For example, the second fastener may be a solid disc or ring shaped comprising one or more holes extending through the second fastener. Each hole may have any desired shape, such as round, square, rectangular, pentagon, hexagon, octagon, and so on. One or more holes, such as square holes, may be present to anchor the second fastener such that the second fastener is mechanically locked into position and may not rotate.

The first fastener may have a shape and/or size matching the size and shape of the second fastener or the size and/or shape may be different. Preferably they are the same size. The first fastener may have a shape and/or size matching the shape and/or size of the cutout. Preferably, the first fastener is substantially smaller than the cutout.

The first and second fastener length and width may each range from about 0.1 to 5 inches, preferably about 0.5 to 2 inches, more preferably about 1 to 2 inches. Preferably, the first and second fasteners are round and the diameter is in the range from about 0.1 to 3 inches, preferably about 0.5 to 2 inches, more preferably about 1 to 1.5 inches, and most preferably about 1.25 inches (about 32 mm).

The first and second fastener thicknesses may range from about 0.01 to about 2 inches, preferably about 0.035 to about 0.25 inch. The first and second fastener thicknesses may be the same or different. Most preferably the first fastener has a thickness of about 0.06 inch (about 1.5 mm) and the second fastener has a thickness of about 0.2 inch (about 5 mm). When the first and second fasteners have the preferred shape and size the cutouts strike a balance between sufficient attraction to sufficiently maintain yet comfortably remove the cutouts from the shutter, large enough in surface area to be sufficiently adhered to a cutout and shutter, and small enough to not be visible from view.

When the second fastener is attached to the rear surface of a shutter, the magnetic attractive force between the first and second fasteners passes through the shutter such that the fasteners attract and magnetically adhere the cutout to the front of the shutter. An advantage of such a design is that the second fastener is concealed within the shutter or may be located on the rear side of the shutter such that when the shutter is installed, such as on a home, the shutter appears unaltered. Existing vinyl shutters manufactured with a hollowed out rear surface comprise a plurality of recesses suitable for a magnet or magnetic material to be located without any modifications necessary to the shutter. Another advantage is that the second fastener is shielded from the environment such as wind, sun, rain, snow, and sea water spray. A further advantage is that the second fastener in less likely to separate from the shutter because it is either embedded within the shutter or is being pulled against the rear surface of the shutter by the first fastener.

At least one of the first fastener and second fastener produces a magnetic field. Preferably, at least one of the first fastener and second fastener comprises a permanent magnetic material. One fastener may comprise a magnetic material and other fastener may also comprise a magnetic material or may comprise a material attracted to magnets such as a ferromagnetic material. Preferably, both the first and second fasteners comprise a magnetic material. The first and second fastener may consist of magnetic or ferromagnetic material or just a portion may comprise magnetic material or ferromagnetic material. An advantage of using two magnets is the magnetic force between two spaced magnets is greater than the magnetic force between a magnet similarly spaced from a metal plate. Most preferably, the first fastener and second fastener each consist of a single permanent magnet.

Suitable materials that can be magnetized, which are also the ones that are strongly attracted to a magnet, include metals such as iron, cobalt, nickel and their alloys and some rare-earth metals. Suitable magnets include neodymium magnets, alnico magnets, ceramic (ferrite) magnets, and samarium cobalt magnets. Neodymium magnets are a type of rare-earth magnet made from an alloy of neodymium, iron, and boron and are preferred magnets of the invention. The neodymium magnet may have any desired grade from N35 to N52.

The magnets may be magnetized in any desired direction such as axially (through the thickness) or diametrically. The magnets may have alternating north and south poles. Preferably, the north and south poles are located on opposing flat faces of the magnets. The magnets may be programmable magnets, such as smart Polymagnets. The magnets may be programmed for concentrated, alignment, latch, or spring magnetism. For example, the magnets may be programmed to attract at one or more orientations and repel (or lose attraction) at one or more orientations when rotated. The first and/or second magnets may be designed with any suitable programmed pattern.

The magnetic and ferromagnetic materials may have any desired shape such as round, triangular, square, rectangular, pentagon, hexagon, octagon, or star shape. The shape may be fit to match the rear surface design of a shutter. The preferred shape is round. A round shape allows the cutout to be easily rotated 360 degrees to any desired orientation. If a set orientation is desired the magnets may have a shape that locks rotation, such as square, rectangular, pentagon, hexagon, octagon, or star shape.

The magnetic or ferromagnetic material size is not particularly limited. Preferably, the first and second magnets have shapes and sizes substantially identical to the shapes and sizes mentioned above for the first and second fasteners, respectively.

The magnetic or ferromagnetic material may be coated with any desired coating material to add functionality or protection. Examples include epoxy, nickel, zinc, tin, gold, chrome, copper, PTFE, nylon, fluorocarbon, aluminum, rubber, hard plastic, soft plastic, or any combination thereof.

Hard plastics include ABS and soft plastics include silicone. The coating may comprise more than one layer such as Ni—Cu, Ni—Cu—Ni, Ni—Cu—Sn, Ni—Cu—Ni—Au, Ni—Cu—Ni—Cr, or Ni—Cu-Epoxy. The coating may be on one or more surfaces. Preferably, the magnetic or ferromagnetic material is completely coated. The coating may be for decorative or functional purposes. For example, the coating may provide a desired appearance such color or provide protection from corrosion, oxidation, scratching, chipping, shattering, or a combination thereof. The preferred coating material is rubber or epoxy. The most preferred coating material is epoxy and preferably the entire magnetic or ferromagnetic material is coated. The epoxy coat may be a dip-paint coat. The epoxy may be colored black (black epoxy) or any other desired color such as white. The coating may be selected to match the color of a shutter. The epoxy coating provides a weather resistant coating while also being sufficiently thin to minimize loss of magnetic strength between the spaced first and second fasteners.

The first fastener and second fastener magnetic pull force are important variables for a properly functioning magnetic shutter. Magnetic pull force is a method of measuring the maximum strength, or holding power, that a magnet has before it is separated from another magnet or a steel plate. In the current invention, the pull force between the first and second fasteners must be strong enough to magnetically adhere the cutout to the shutter front surface and remain stationary through rain and wind and other external events yet loose enough that one may reach out a window and easily remove the cutout from the shutter. Such a fastening system allows for easy placement and removal of the cutouts from the shutters and without the need for a ladder. Factors affecting the pull force between the first and second fasteners include fastener locations, fastener compositions, fastener thicknesses, fastener surface areas, and fastener shapes. For example, a 0.2 inch thick and 1.25 inch diameter N52 neodymium disc magnet located on the front surface of a shutter has an estimated magnet to magnet and magnet to steel plate pull strength of about 34 pounds but the same magnet located on the rear surface of a shutter, wherein the shutter has a thickness of about 0.1 inch, has an estimated magnet to magnet shutter front surface pull force of about 14 pounds and an estimated magnet to steel plate shutter front surface pull force of about 10 pounds.

The maximum weight that a magnetic shutter can hold varies depending on the direction of the application of force. Magnetic pull force is measured in terms of perpendicular (to the magnetic surface) force but if the holding strength acts parallel to the contact surface (shear direction), as occurs in the current invention when a shutter is installed vertically against a structure, the maximum value is much smaller than the magnet pull force. In other words, the amount of strength necessary to pull a magnet off a shutter at a right angle to the shutter front surface is much more that the amount of strength necessary to slide a magnet sideways off a shutter. In the current invention the pull force is not perpendicular to the contact surface and the maximum holding power also depends on the frictional force between the shutter surface and the second fastener. If the maximum holding power is approached, the cutout rotates due to wind. If the maximum holding power is exceeded, the cutout starts slipping from the shutter surface. The maximum frictional force depends on factors such as roughness of both contact surfaces and contact pressure. The rougher both surfaces, the higher the maximum frictional force. The higher the contact force that presses both contact surfaces together, the higher the maximum frictional force.

A magnet pull strength for each of the first and second fasteners is preferably in a range of about 5 to about 35 pounds. The second fastener magnet pull strength is preferably about 20 to about 35 pounds and more preferably about 25 to about 30 pounds. The first fastener magnet pull strength is preferably about 5 to about 15 pounds and more preferably about 5 to about 10 pounds. The ranges take into consideration a variety of variables including the spacing between the first and second fasteners, the average weight of a cutout, the ideal amount of force comfortable for one to remove a cutout from the surface of a shutter from an adjacent window, the surface roughness of the average shutter, and the surface roughness of the second fastener.

Magnetic attraction decreases as the spacing between two magnetic materials increases. It is preferred that the first material thickness be less than about 0.5 inch, more preferably less than about 0.25 inch, and most preferably less than about 0.125 inch.

The first and second fasteners may be attached by any suitable method, such as adhesive. A second adhesive may be positioned between the shutter rear surface and the second fastener to adhere the second fastener to the rear surface of the shutter. A first adhesive may be positioned between the first fastener and the cutout to adhere the cutout to the first fastener.

In a preferred embodiment of the invention, a second fastener is adhesively attached to the rear surface of the shutter with 0.4 mm thick acrylic foam and the second fastener is a round epoxy coated N45 neodymium countersunk magnet having a diameter of about 1.25 inches (32 mm) and a thickness of about 0.2 inch (5 mm).

In a preferred embodiment of the invention the cutout is made of opaque colored acrylic with a length and width each between about 2 to about 16 inches and a thickness of about ⅛ inch (3 mm). A first fastener is adhesively attached to the rear surface of the cutout with about 1.6 mm thick acrylic foam and is a round epoxy coated N35 neodymium disc magnet having a diameter of about 1.25 inches (32 mm) and a thickness of about 0.06 inch (1.5 mm). The first adhesive adheres the first magnet to the cutout and no other magnet of equal length or width as the first magnet is adhered to the cutout. When the cutout is brought into close proximity to the front surface of the shutter, opposite the second fastener, the two magnets attract and magnetically hold the cutout to the front surface of the shutter. The size and compositions of the magnets are ideal such that the cutout is firmly magnetically held to the front of the shutter yet the cutout is easily slid apart from the shutter when desired.

Figure 6:
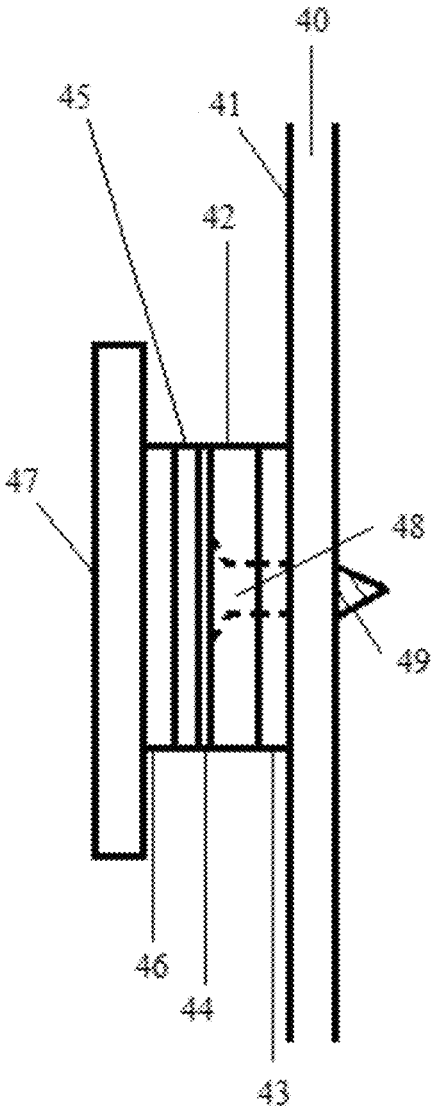
FIG. 6 is a side view of an embodiment of the invention wherein a second fastener 42 is attached to a shutter front surface 41 and a cutout 47 is attached to a first fastener 45 and magnetically attracted to the second fastener 42.

In another embodiment of the invention, as shown in FIG. 6, a second fastener 42 is installed on the front surface 41 of a shutter 40. The second fastener 42 may be attached to the shutter 40 by any suitable method. For example, a second adhesive 43 may be positioned between the shutter front surface 41 and the second fastener 42 to adhere the second fastener 42 to the shutter 40. The second fastener 42 may be ring shaped and comprise a countersunk hole 48 and the second adhesive 43 may also be ring shaped. A screw 49 may be used instead of or in addition to the second adhesive 43 to anchor the second fastener 42 to the shutter 40. The second fastener 42 may be installed on the front surface 41 or the front surface may comprise a recess (not shown) in the shutter front surface 41 and a second fastener 42 may be placed within the recess such that the front surface of the second fastener 42 is substantially flush with the shutter front surface 41. A first adhesive 46 may be positioned between a cutout 47 and a first fastener 45 to adhere the cutout 47 to the first fastener 45. An outer cover 44 may be attached to the second fastener 42. The first fastener 45 may also comprise an outer cover (not shown). The magnetic attraction between the second fastener 42 and first fastener 45 must be sufficiently strong, such that the cutout 47 attached to the first fastener 45 will be sufficiently pressed against the second fastener 42 and remain positioned against the second fastener 42 unless intentionally removed.

If the second fastener is attached to the front surface of the shutter, rather than attached to the rear surface of the shutter, the second fastener adhesive may be the only component maintaining the second fastener to the shutter when the cutout is pulled away from the shutter. Therefore, additional second fastener attachment means is advantageous. Therefore, the second fastener is preferably adhered to the front surface of the shutter and additionally screwed into the shutter. The second fastener may be a countersunk magnet or magnetic material, comprising a countersunk hole through the second fastener, such that a screw may be driven into the countersunk hole and into the shutter to further anchor the second fastener to the shutter. The countersunk hole diameter may be between about 2 to about 10 mm, preferably about 5 mm. The screw may be any desired size such as a #10 wood or sheet metal screw having a length of about 0.5 to 2 inches, preferably about ¾ inch. Preferably the screw is substantially non-magnetic, such as a non-magnetic stainless steel, so the screw does not magnetically attract to the magnet when installing through the countersunk magnet. The screw may be coated as desired. For example, the screw may be black oxide coated rendering the screw black in color or the screw may be painted. The screw color may match the shutter color and/or the second fastener color. For example, the screw and second fastener may both be black or white in color.

One or both of the first fastener and the second fastener may be coated or covered with an outer cover. The outer cover may be single or multi-layer cover and the outer cover may partially or totally cover the first or second fastener. The outer cover may be adhered to the first or second fastener with any suitable adhesive and/or the outer cover may be unadhered and attach with a snug friction grip. The outer cover may only cover the magnetic fastening surface of the first and/or second fasteners or the outer cover may partially or completely wrap around the first or second fastener. The cover may provide any desired surface effect such as aesthetics, preventing scratching, and/or increasing or decreasing friction. The outer cover may be a film and may have a thickness of ranging from about 0.01 to 0.25 inches and a diameter ranging from about 0.5 to 2 inches.

In one embodiment of the invention the outer cover may reduce or eliminate fastener surface scratching. Examples of anti-scratch polymeric film materials are polyethylene (such as low-density polyethylene), polypropylene (such as biaxially-oriented polypropylene), vinyl, and polystyrene. The outer cover may comprise an adhesive backing such that the outer cover adheres to the surface of the magnet or magnetic material. The outer cover may comprise a black and white or color image or pattern such as a logo or brand name. The outer cover may prevent direct contact between the first and second fasteners. For example, if the first fastener is located on the front surface of the shutter and if the first and second fasteners are epoxy coated neodymium magnets, one or more of the first and second magnets may be coated with an outer cover layer to prevent either epoxy coated magnet surface from scratching.

The outer cover of the first and/or second fasteners dictate the surface friction experienced by the cutouts when removed from the shutter. The invention intends for cutouts to be added and removed from shutters by pulling or sliding the cutouts off the shutter front surface or off a second fastener surface. The repeated separating action between the two fastener contacting surfaces, or between the first fastener and the shutter surface, can result in undesirable scratching or insufficient or excessive friction. A high degree of friction was discovered to be desirable to maintain the orientation of the cutout on the shutter such that the cutout is prevented from undesirable rotation. On the other hand, a low degree of friction was discovered to be desirable to allow the cutout to easily separate from the shutter. The preferred embodiments of the invention strike a middle ground amount of friction and may be optimized in view of the present disclosure teachings. One or more outer covers may be present to increase or decrease friction between the first and second fasteners. To increase friction a high friction material such as a glossy surface vinyl polymer or silicone may be used to increase friction. To decrease friction a low friction material such as matte surface biaxially-oriented polypropylene, PTFE, or metallized polyester may be used to decrease friction.

The outer cover may be decorative in nature. When the second fastener is attached to the front surface of the shutter the second fastener is visible when a cutout is not attached to the shutter. Therefore, it may be desirable to provide the second fastener with a decorative outer cover. The outer cover may be made with any desired pattern or color. For example, the outer cover may comprise a pattern or color similar or identical to the pattern or color of the front surface of the shutter such that the second fastener blends into the surface appearance of the shutter. For example, the outer cover may have a wood grain appearance. Alternatively, the outer cover may comprise a pattern and/or color different than the shutter to stand out or decorate the shutter. The first fastener may comprise a first outer cover and the second fastener may comprise a second outer cover. The first and second outer cover material may be the same of different.

In one embodiment of the invention an outer cover is a vinyl adhesive backed film present only on the outermost surface of the second fastener and having a thickness of about 0.1 inch or less. In another embodiment of the invention the outer cover is a low-density polyethylene cap that covers the outermost surface and sides of the second fastener and having a thickness of about 0.2 inch or less.

Preferably, the outer cover of the first fastener is an adhesive backed film having a diameter of about 1.0 to about 1.5 inches, more preferably about 1.25 inches. Ideally, the film substantially covers the magnet fastening surface (surface opposite the adhesive surface) such that the magnet fastening surface is protected. The preferred film material is polyester or polypropylene.

Preferably, the outer cover of the second fastener is a cap that covers all the surfaces of the first or second magnet except for magnet fastening surface (surface opposite the adhesive surface). The cap may adhere to the second fastener or snugly fit over the second fastener and attaches by a friction grip. The cap preferably has an interior dimension substantially identical to the second fastener outer dimensions, or slightly smaller, such that the cap fits over the second fastener. In the event that the second fastener is a round magnet, the cap may be round and have an interior diameter equal to or slightly smaller than the magnet diameter. For example, the magnet may have a diameter of 32 mm and the cap may have an interior diameter of 32 mm or slightly smaller, such as 31.50 to 31.99 mm, such that the cap fits over the magnet or slightly stretches around the magnet. The preferred material is low-density polyethylene (LDOE) and may be an elastomeric material such as elastomeric LDPE. The cap may have a wall thickness ranging from 0.5 mm to 3 mm, preferably 0.5 to 2.0 mm, most preferably about 1.0 mm. The cap may have an interior dimension height greater than the height of the second fastener such that when the cap is fitted over the second fastener the sides of the cap extend beyond the sides of the second fastener. For example, the second fastener may be a round 32 mm magnet having a thickness of 5 mm and coated with a round 32 mm diameter 1.6 mm thick adhesive. The cap may have an interior height ranging from 5 mm to 6.6 mm. When the cap interior height is 5 mm, the cap covers the sides of the magnet but not the sides of the adhesive. When the cap interior height is 6.6 mm, the cap covers the sides of the magnet and the sides of the adhesive. When adhesive is present between the cap and the second fastener the adhesive may be an acrylic foam substantially identical to the acrylic foam adhesive used to attach the second fastener to the shutter. Preferably, the cap adhesive has a thickness of about 0.016 inch (0.4 mm).

The first fastener may be positioned anywhere between top and bottom edges of the cutout and anywhere between left and right edges of the cutout. For example, the first fastener may be spaced from the top and/or bottom edge of the cutout by a distance of at least 5, 10, 15, 20, 25, 30, 35, 40, 45, or 50% of the cutout height and the first fastener may be spaced from the left and/or right edge of the cutout by a distance of at least 5, 10, 15, 25, 30, 35, 40, 45, or 50% of the cutout width. The first fastener is preferably spaced from each of the top and bottom edges of the cutout by a distance of at least 20% of the cutout height and the first fastener is preferably spaced from each of the left and right edges of the cutout by a distance of at least 20% of the cutout width. Most preferably a single first fastener is positioned in about the middle of the cutout. The first fastener is preferably positioned on a surface of the cutout parallel with the plane of the cutout.

The second fastener of the current invention may be located anywhere on the shutter front surface, the shutter rear surface, or within the shutter. The second fastener may be positioned anywhere between the top and bottom edges of the shutter and anywhere between the left and right edges of the shutter. For example, the second fastener may be spaced from the top and/or bottom edges of the shutter by a distance of at least 5, 10, 15, 20, 25, 30, 35, 40, 45, or 50% of the shutter height and the second fastener may be spaced from the left and/or right edges of the shutter by a distance of at least 5, 10, 15, 25, 30, 35, 40, 45, or 50% of the shutter width. The second fastener is preferably spaced from each of the top and bottom edges of the shutter by a distance of at least 20% of the shutter height and the second fastener is preferably spaced from each of the left and right edges of the shutter by a distance of at least 20% of the shutter width. Preferably one or more fasteners are positioned in about the middle of the shutter, in the middle of one or more raised or grooved panels, halfway between two battens, or between louver panels. The second fastener is preferably positioned on a surface of the shutter parallel with the plane of the shutter.

Adhesive

The first fastener adhesive (first adhesive) and second fastener adhesive (second adhesive) are weather resistant and may be acrylic foam adhesives, such as VHB™ adhesive made by 3M™. The adhesive thickness may vary from about 0.01 to about 0.5 inch, preferably 0.01 to 0.25 inch, more preferably 0.015 to 0.065 inch. The first adhesive thickness may be the same or different than the thickness as the second adhesive. The first adhesive thickness may be the same thickness or a different thickness than the second adhesive thickness. The adhesive may be colored, such as white, gray, or black, or the adhesive may be clear. The adhesive may be solid or comprise a hole.

Preferably the first adhesive is thicker than the second adhesive when the second fastener is attached to the rear surface of the shutter. A thicker first adhesive provides additional cushion to the first fastener such the first magnet is less likely to crack or break during use. A thinner second adhesive reduces the spacing between the two fasteners and therefore increases magnetic force between the first and second magnets. For example, the second adhesive may have a thickness of about 0.016 inch (0.4 mm) and the first adhesive may have a thickness of about 0.063 inch (1.6 mm) when the second fastener is attached to the rear surface of the shutter.

Preferably the first adhesive is about the same thickness as the second adhesive when the second fastener is attached to the front surface of the shutter. A thicker first and second adhesive provides additional cushion to the first and second fasteners such that the first and second magnets are less likely to crack or break during use. For example, the first and second adhesives may each have a thickness of about 0.063 inch (1.6 mm). The second adhesive preferably comprises a hole when the second fastener is attached to the front surface of a shutter such that a screw may pass through a second fastener countersunk hole and adhesive hole.

When a cutout is a lighter color, such as yellow or white, the adhesive may be slightly visible through the cutout. Therefore, the first adhesive may be light colored, such as white, or clear such that the adhesive is less noticeable. The adhesive color may be selected to substantially match the color of the cutout. For example, a white cutout may be adhered to a first fastener with a white first adhesive.

Kits

The first and/or second fastener may be offered in a kit. The kit may comprise one or more of the above components such as a magnet, adhesive, screw, and/or outer cover. In addition, the kit may include a cleaning pad, such as an isopropyl alcohol impregnated cleaning pad, to clean a surface in preparation for adhesive application. The cleaning pad may comprise a two-ply 50 to 70% isopropyl alcohol impregnated pad sealed within a cleaning pad envelope for freshness.

A first kit includes components suitable for attaching a first fastener to a cutout. A first kit may comprise one more of the flowing: a first fastener, a first adhesive, and a first outer cover, each as described above. A preferred first kit comprises: a first magnet, a first adhesive, and optionally a first outer cover and/or cleaning pad. The kit may include one of each of the above components but preferably comprises two of each of the above components. The kit may comprise a sandwich construction wherein two outer layers sandwich a middle layer wherein the middle layer comprises a cutout area to hold the at least one first fastener, first adhesive, and/or first outer cover. The cutout dimensions may be substantially identical to the outer dimensions of the first magnet of first fastener. The kit outer layers may provide protection to the first fastener. The outer and middle layers may be made of any suitable material such as cardboard, foam, or pressed pulp. Preferably, the outer and middle layers each comprise double walled cardboard having a height of about 0.25 inch. The kit may comprise a box, such as a kraft reverse tuck box, to contain the outer and middle layers, such as a paper or chipboard box. The box may be printed or coated with one or more labels to indicate the contents within. The label may be constructed with the box, such as with a custom-made surface printed box, or a label may be applied to the box such as with adhesive. Preferably, the label is a sticker applied to at least one surface of the box. The box dimensions may vary from about the same size as the first fastener to larger than the first fastener. Preferably, the box is between about 2 to about 3 inches in length and/or width and between about 0.5 to about 2 inches in height. Preferably, the box has L×W×H dimensions of about 2⅜×2⅜×⅞ inch. The first kit may include product instructions. The instructions may comprise paper printed with instructions. The paper may be folded, such as twice lengthwise, wrapped around the outer and middle layers, and placed within the box.

A second kit includes components suitable for attaching a second fastener to the front surface of a shutter. A second kit may comprise one or more of the following: a second fastener, a second adhesive, a screw, and a second outer cover, each as described above. A preferred second kit comprises: a second magnet, a second adhesive, a second outer cover, a cleaning pad, and a screw. The kit may comprise a sandwich construction wherein two outer layers sandwich a middle layer wherein the middle layer comprises a first cutout area to hold the at least one first fastener, the first adhesive, and/or the first outer cover. A second cutout area may be present for the screw. The first cutout dimensions may be substantially identical to the outer dimensions of the second magnet of second fastener and the second cutout dimensions may be substantially identical to the outer dimensions of the screw. The kit outer layers may provide protection to the second fastener. The outer and middle layers may be made of any suitable material such as cardboard, foam, or pressed pulp. Preferably, the outer and middle layers each comprise double walled cardboard having a height of about 0.25 inch. The kit may comprise a box, such as a kraft reverse tuck box, to contain the outer and middle layers, such as a paper or chipboard box. The box may be printed or coated with one or more labels to indicate the contents within. The label may be constructed with the box, such with a custom-made surface printed box, or a label may be applied to the box such as with adhesive. Preferably, the label is a sticker applied to at least one surface of the box. The box dimensions may vary from about the same size as the first fastener to larger than the first fastener. Preferably, the box is between about 2 to about 3 inches in length and/or width and between about 0.5 to about 2 inches in height. Preferably, the box has L×W×H dimensions of about 2⅜×2⅜×⅞ inch. The second kit may include product instructions. The instructions may comprise paper printed with instructions. The paper may be folded, such as twice lengthwise, wrapped around the outer and middle layers, and placed within the box.

A third kit includes components suitable for attaching a second fastener to a rear surface of a shutter. A third kit may comprise one more of the flowing: a second fastener, a second adhesive, and a second outer cover, each as described above. A preferred third kit comprises: a second magnet, a second adhesive, a second outer cover, and a cleaning pad. The kit may comprise a sandwich construction wherein two outer layers sandwich a middle layer wherein the middle layer comprises a cutout area to hold the at least one second fastener, the second adhesive, and/or the second outer cover. The cutout dimensions may be substantially identical to the outer dimensions of the second magnet of second fastener. The kit outer layers may provide protection to the second fastener. The outer and middle layers may be made of any suitable material such as cardboard, foam, or pressed pulp. Preferably, the outer and middle layers each comprise double walled cardboard having a height of about 0.25 inch. The kit may comprise a box, such as a kraft reverse tuck box, to contain the outer and middle layers, such as a paper or chipboard box. The box may be printed or coated with one or more labels to indicate the contents within. The label may be constructed with the box, such with a custom-made surface printed box, or a label may be applied to the box such as with adhesive. Preferably, the label is a sticker applied to at least one surface of the box. The box dimensions may vary from about the same size as the first fastener to larger than the first fastener. Preferably, the box is between about 2 to about 3 inches in length and/or width and between about 0.5 to about 2 inches in height. Preferably, the box has L×W×H dimensions of about 2⅜×2⅜×⅞ inch. The third kit may include product instructions. The instructions may comprise paper printed with instructions. The paper may be folded, such as twice lengthwise, wrapped around the outer and middle layers, and placed within the box.

Methods

A method of making a shutter product of the invention comprises forming or obtaining a cutout and attaching a first fastener to the cutout. A forming step may comprise laser cutting a material such as acrylic and a first cutout attachment step may comprise applying adhesive to the cutout and/or first fastener and adhering the first fastener to the cutout. A second cutout attachment step may comprise magnetically adhering the cutout to a shutter.

A method of making a shutter of the invention comprises forming or obtaining a shutter and attaching a second fastener to the shutter. The forming step may comprise molding a material such as vinyl and an attachment step may comprise applying adhesive to the shutter and/or second fastener and adhering the second fastener to the shutter.

A method of making a first fastener kit comprises forming inserts, by any suitable method such as by laser cutting or sawing, wherein a middle insert layer comprises at least one cutout shape. The inserts are stacked and may be wrapped with a sheet of instructions. A cleaning pad is included. The kit components are then inserted into a suitable box wherein a sticker may be applied to the box to indicate contents and branding.

Applications

The fasteners and cutouts of the invention have been described for use with a shutter but are suitable for a variety of alternative uses. Any location wherein a cutout may be desirable is suitable, including any conventional or unconventional magnet location. Non-limiting examples include cutouts fastened to doors, fences, walls, lockers, mailboxes, garage doors, tombstones, or any other location signage is used or capable of use.

INCORPORATION BY REFERENCE

All patent applications and patents cited herein are incorporated herein by reference in the entireties, except for any definitions, subject matter disclaimers or disavowals, and except to the extent that the incorporated material is inconsistent with the express disclosure herein, in which case the language in this disclosure controls.

What is claimed is:

1. A magnetic exterior shutter product, comprising:

a cutout comprising laser cut acrylic;

a first adhesive; and a first fastener comprising a first magnet; wherein the first adhesive is located between the cutout and the first fastener;

the first magnet has a magnetic pull force between 5 to 15 pounds;

the first magnet is adhered to the cutout and no other magnet is adhered to the cutout;

the cutout has a length between 2 and 18 inches;

the cutout has a width between 2 and 18 inches;

the cutout has a thickness between 0.075 and 0.35 inch;

the first magnet is round with a diameter of between 1.0 and 1.5 inches;

the first magnet has a thickness between 0.035 and 0.25 inch; and the first adhesive has a thickness between 0.01 and 0.25 inch.

2. The magnetic exterior shutter product of claim 1, wherein:

the cutout has a pine tree, bird, star, spade, diamond, fleur-de-lis, heart, flower, cross, dragon, butterfly, flag, race car, pumpkin, ghost, turkey, Christmas tree, snowman, or snowflake shape that includes one or more areas wherein material is laser cut out; and the cutout has a material light transmission of 30% or less.

3. The magnetic exterior shutter product of claim 1, wherein:

the first magnet is a neodymium disc magnet.

4. The magnetic exterior shutter product of claim 3, wherein:

wherein the first magnet is a N35 neodymium disc magnet.

5. The magnetic exterior shutter product of claim 4, wherein:

the first magnet is axially magnetized; and the first magnet has a thickness of between 0.05 and 0.07 inch.

6. The magnetic exterior shutter product of claim 1, wherein:

the first adhesive directly contacts the cutout and the first magnet; and the first adhesive comprises acrylic foam having a thickness of 0.015 to 0.065 inch.

7. The magnetic exterior shutter product of claim 1, wherein:

the first fastener is spaced from a top edge of the cutout by a distance of at least 20% of the cutout length;

the first fastener is spaced from a bottom edge of the cutout by a distance of at least 20% of the cutout length;

the first fastener is spaced from a left edge of the cutout by a distance of at least 20% of the cutout width; and the first fastener is spaced from a right edge of the cutout by a distance of at least 20% of the cutout width.

8. The magnetic exterior shutter product of claim 1, wherein the first fastener is magnetically attached to a shutter, the shutter comprising:

a shutter front surface;

a shutter rear surface; and a second fastener comprising a second magnet having a third magnet surface and a fourth magnet surface; wherein the first fastener is magnetically attracted to the second fastener;

the shutter front surface is fixed louvered, raised panel, grooved panel, board and batten, or a combination thereof; and a) the second fastener is attached to the shutter rear surface or embedded between the shutter front surface and the shutter rear surface; the second fastener is spaced from the shutter front surface by a distance of % inch or less; a first material is between the second fastener and the shutter front surface; the first material consisting of polymer, wood, or a combination thereof; or b) the second fastener is attached to the shutter front surface; the second magnet comprising a countersunk hole; the third magnet surface is coated with a second adhesive that adheres the second magnet to the shutter front surface; the second adhesive comprises a hole; the fourth magnet surface is covered by an outer cover wherein the outer cover comprises polymeric material.

9. The magnetic exterior shutter product of claim 8, wherein:

the shutter has a height defined by a distance between top and bottom edges of the shutter;

the second fastener is spaced from the top edge of the shutter by a distance of at least 20% of the shutter height; and the second fastener is spaced from the bottom edge of the shutter by a distance of at least 20% of the shutter height.

10. The magnetic exterior shutter product of claim 8, wherein:

the second fastener is attached to the shutter rear surface such that magnetic attractive force between the first and second fasteners passes through the shutter and the first and second fasteners attract and magnetically adhere the cutout to the shutter front surface.

11. The magnetic exterior shutter product of claim 10, wherein:

the shutter is a vinyl shutter; and the first material comprises vinyl.

12. The magnetic exterior shutter product of claim 8, wherein:

the second magnet is an axially magnetized N42 neodymium magnet;

the second magnet is completely coated by a coating material comprising epoxy; and the second magnet has a magnetic pull strength between about 20 to about 35 pounds.

13. The magnetic exterior shutter product of claim 8, wherein:

the shutter front surface has a wood grain texture; and the shutter rear surface is substantially smooth.

14. The magnetic exterior shutter product of claim 8, wherein:

the second fastener is attached to the shutter front surface.

15. The magnetic exterior shutter product of claim 14, wherein:

the outer cover is a low-density polyethylene cap that covers all surfaces of the second magnet except the third magnet surface.

16. The magnetic exterior shutter product of claim 14, wherein:

the second adhesive comprises acrylic foam; and the second fastener and second adhesive are both ring shaped.

17. The magnetic exterior shutter product of claim 8, wherein:

the first and second fasteners are both round; and the first and second fasteners have the same diameter.

18. A magnetic shutter, comprising:

a shutter front surface;

a shutter rear surface; and a fastener comprising a magnet the magnet having a first magnet surface and a second magnet surface;

the shutter front surface is fixed louvered, raised panel, grooved panel, board and batten, or a combination thereof; and a) the fastener is attached to the shutter rear surface or embedded between the shutter front surface and the shutter rear surface; the fastener is spaced from the shutter front surface by a distance of % inch or less; a first material is between the fastener and the shutter front surface; the first material consisting of polymer, wood, or a combination thereof; or b) the fastener is attached to the shutter front surface; the magnet comprising a countersunk hole; the first magnet surface is coated with an adhesive that adheres the magnet to the shutter front surface; the adhesive comprises a hole; the second magnet surface is covered by an outer cover wherein the outer cover comprises polymeric material.

19. The magnetic shutter of claim 18, wherein:

the fastener is attached to the shutter rear surface or embedded between the shutter front surface and the shutter rear surface;

the fastener is spaced from the shutter front surface by a distance of % inch or less;

a first material is between the fastener and the shutter front surface;

the first material consisting of polymer, wood, or a combination thereof;

the shutter front surface has a wood grain texture; and the shutter rear surface is substantially smooth.

20. A magnetic exterior shutter product, comprising:

a cutout comprising acrylic;

a first adhesive; and a first fastener comprising a first magnet; wherein the first magnet comprises a first magnet surface and a second magnet surface;

the first magnet surface is coated with the first adhesive; and the second magnet surface is coated with an adhesive backed vinyl or polypropylene film;

the first adhesive is located between the cutout and the first fastener;

the first magnet has a magnetic pull force between 5 to 15 pounds;

the first magnet is adhered to the cutout and no other magnet is adhered to the cutout;

the cutout has a length between 2 and 18 inches;

the cutout has a width between 2 and 18 inches;

the cutout has a thickness between 0.075 and 0.35 inch;

the first magnet is round with a diameter of between 1.0 and 1.5 inches;

the first magnet has a thickness between 0.035 and 0.25 inch; and the first adhesive has a thickness between 0.01 and 0.25 inch.

* * * * *